United States Patent [19]

Hirth et al.

[11] Patent Number: 4,836,431

[45] Date of Patent: Jun. 6, 1989

[54] SEMI-AUTOMATIC LOADING PAPER FEED TRACTOR

[75] Inventors: Gregory F. Hirth, San Jose, Calif.; Terry L. Branson, Plano, Tex.

[73] Assignee: Dataproducts Corporation, Woodland Hills, Calif.

[21] Appl. No.: 148,883

[22] Filed: Jan. 27, 1988

Related U.S. Application Data

[62] Division of Ser. No. 863,704, May 15, 1986.

[51] Int. Cl.[4] ..... B65H 17/40; B41J 11/32

[52] U.S. Cl. ..... 226/74; 400/616.1

[58] Field of Search ..... 226/74, 75; 400/616–616.3; 16/298

[56] References Cited

U.S. PATENT DOCUMENTS

| | | | |
|---|---|---|---|
| 1,586,615 | 6/1926 | Elliott | 16/298 |
| 4,365,905 | 12/1982 | Jung | 400/616.2 |
| 4,566,618 | 1/1986 | Seitz et al. | 226/74 |

*Primary Examiner*—David Werner

*Attorney, Agent, or Firm*—Spensley Horn Jubas & Lubitz

[57] ABSTRACT

A tractor is provided with an endless belt which travels in a triangular path and a drive shaft located well below the level of the paper path. The tractor body has both an inner and outer body portion, each of which contains a journal bearing for support on the support shaft. An adjustable torsion spring lock is provided on the outer body portion and surrounds the support shaft to allow for easy locking adjustment of the axial location of the tractor on the support shaft. A front and rear closeable panel are provided along the document feed path. Only the front panel need be opened during feeding while both front and rear panels may be opened to clear the feed path during advancement jam. Two mirror image features are provided at the entrance of the feed path on either body portion such as to cover document pins located on the belt path and thereby decrease likelihood of injury to an operator during feeding operations. A unique configuration of belt teeth pitch, pin pitch, and number of drive sprocket teeth is provided to allow for easy adjustment of belts in each tractor located at opposite sides of a document.

6 Claims, 5 Drawing Sheets

SEMI-AUTOMATIC LOADING PAPER FEED TRACTOR

This is a division of application Ser. No. 863,704 filed on May 15, 1986, pending.

BACKGROUND OF THE INVENTION

1. Field of the Invention

The present invention relates to a mechanism for feeding, advancing, and positioning web material, and in particular a mechanism for use in feeding edge perforated documents used in printers, teletypewriters, and the like.

2. Description of Related Art

Paper is often fed to high speed printers by a pair of tractors that have toothed belts which engage holes provided along the borders of the paper sheet. The toothed belts are often trained around two wheels, a drive wheel and an idler wheel. It is important that the belts move synchronously and in tandem so that both edges of the paper are advanced at the same rate and at the same time. For this reason, the drive wheels of both of the belts are typically driven by a single drive shaft. Another shaft, usually parallel to the drive shaft, is used to support the tractors Documents come in varying widths and the spacing of the perforations with respect to the edge of the document may vary. Accordingly, the tractors must be positionable (i.e., movable axially) along the drive and support shafts. When the position of both tractors in proper alignment with the document perforations is obtained, the tractors must be fixed in position. The clamps must also be releaseable so as to allow for repositioning of the tractors for documents of varying width.

It is an object of the present invention to provide an improved feed mechanism for feeding of documents which mechanism may be positioned and clamped in position and wherein the foregoing difficulties and disadvantages are avoided.

It is a further object of the present invention to provide an improved document tractor which substantially reduces the possibility of interference between the document and the drive shaft.

It is a still further object of the present invention to provide an improved document tractor which reduces the likelihood of injury to the operator during feeding, adjustment or maintenance operations.

It is a still further object of the present invention to provide an improved document tractor which allows the operator to view documents directly during operation.

It is a still further object of the present invention to provide an improved document tractor which allows an operator to easily align the respective belts of a tractor pair such that the pins of such belts are in the same relative position with respect to the document being advanced It is a still further object of the present invention to provide an improved document tractor which increases ease of document loading, ease of clearing jams, and ease of attaining a maximum driving force The foregoing and other objects, advantages, and features of the invention as well as presently preferred embodiments thereof will become more apparent from a reading of the following description in connection with the accompanying drawings.

SUMMARY OF THE INVENTION

The foregoing advantages are accomplished in the present invention by providing a tractor having an endless belt which travels in a "triangular" path, with the drive shaft located below the level of the paper. This reduces the likelihood of interference of the document with the drive shaft. The increased pin pullout radius at the end of the feed path also reduces the likelihood of tearing of the document. The endless belt is housed within a tractor having both an inner and outer body portion, each of which has a journal bearing to accept and share the load of the support shaft of the tractor. Located in the outer body portion is a torsion spring which surrounds the support shaft, and is manually adjustable in tension, this allowing for easy locking adjustment of the axial location of the tractor on the support shaft. A front and rear closeable panel are provided along the feed path of the document such that the front panel may be opened to load documents while both front and rear panels may be opened to clear the feed path during a document jam. Two mirror images further are provided at the entrance of the feed path in either body portion to cover document pins located on the paper path to restrict the ability of an operator to accidentally come into contact therewith. Furthermore, a unique configuration of belt teeth pitch, pin pitch and drive sprocket teeth is provided to allow for easy alignment of belts in each tractor located at opposite sides of a document.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention. The scope of the invention is best defined by the appended claims.

It will be understood that the tractor devices of the present invention are generally utilized in pairs, with each tractor corresponding to one edge of the document being advanced. The specification is directed to an explanation of the tractor to be utilized on the "right hand" side of a document feed mechanism, it being understood that the tractor mechanism being utilized on the left hand side of such printer will be a mirror image of the tractor device herein described.

Figure 1:
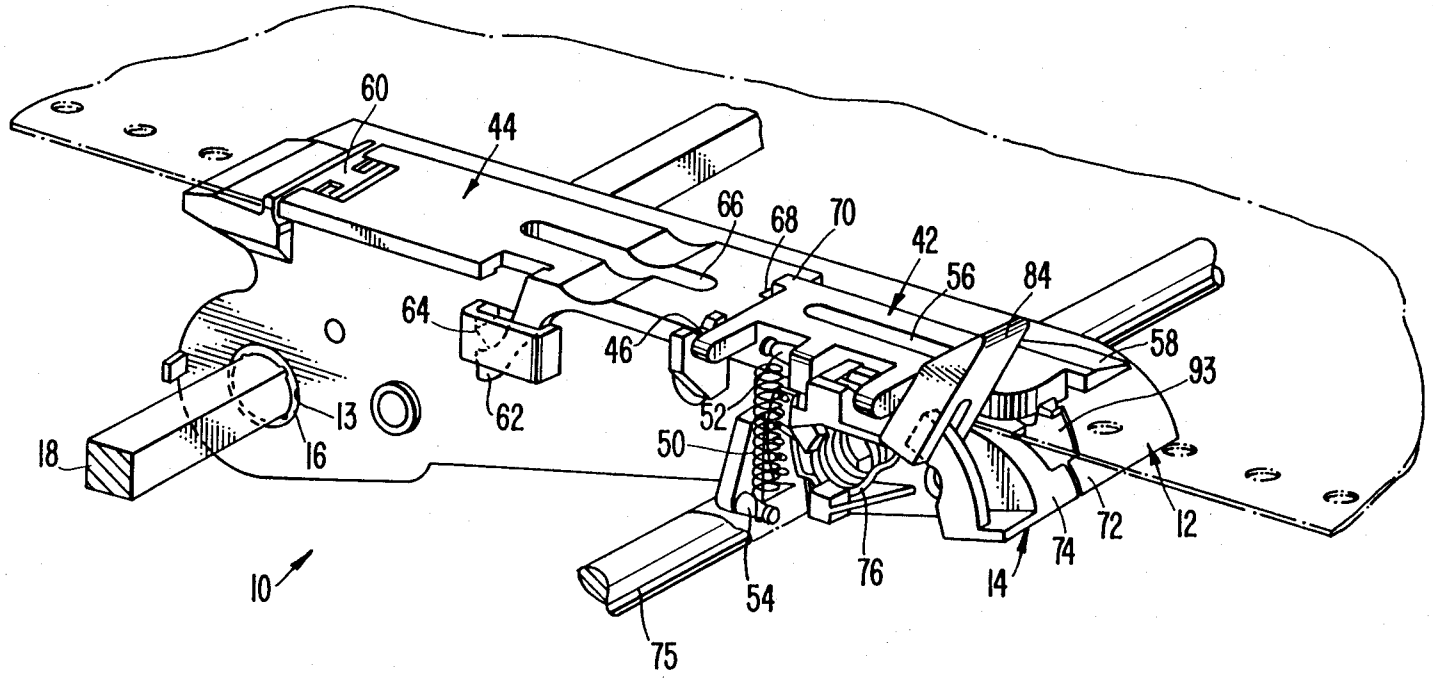
FIG. 1 is an exterior side view in elevation of the assembled tractor of the present invention.
Figure 2:
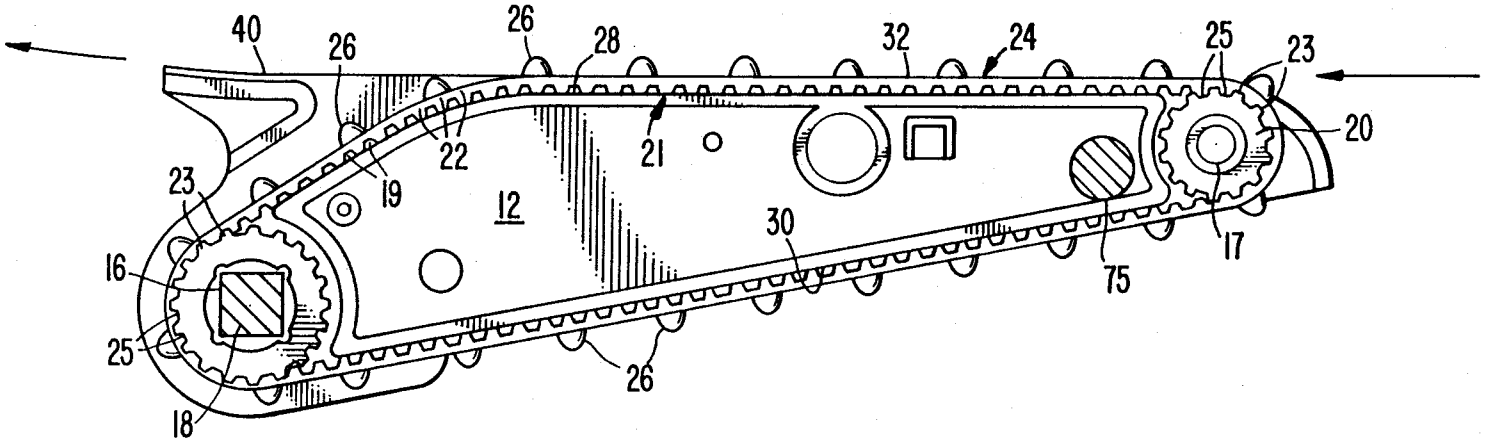
FIG. 2 is an interior view of the inner body portion of the tractor shown in FIG. 1.

FIG. 1 shows a tractor generally designated by the number 10. The tractor 10 is made up of an inner body portion 12 and an outer body portion 14 The inner and outer body portions may be press-fit together by means of round or oblong pins (see FIG. 2) on the inner body portion 12 which are aligned with corresponding holes or slots (not shown) on the outer body portion 14. A single set screw (not shown) may be used to assure that the inner body portion 12 and outer body portion 14 do not separate from one another Referring to FIG. 2, which depicts parts of the interior surface of inner body portion 12, a drive sprocket 16 is supported at the rear of tractor 10 by a cylindrical bearing surface 13 in the inner body portion 12. The drive sprocket 16 surrounds and is driven by a keyed drive shaft 18 which extends through the center of the drive sprocket 16. In the preferred embodiment of the present invention, the keyed drive shaft 18 has four sides, although it is recognized that keyed shafts having a different number of sides may also be used to drive the drive sprocket 16. An idler sprocket 20 is supported by a bearing cylinder 17 which is fixed to the inner body portion 14 near the front end of the tractor 10.

A continuous flexible belt 24 is looped around the drive sprocket 16 and idler sprocket 20. The interior surface of the belt 24 is configured with a plurality of equally spaced ridges 22 and troughs 19 which together form an interior belt tread 21. The exterior circumferential surfaces of both the drive sprocket 16 and idler sprocket 20 are likewise configured with a plurality of equally spaced ridges 23 and troughs 25 which are configured to engage the ridges 22 and troughs 19 of the interior belt tread 21. Rotational movement of the drive sprocket 16 is thereby transmitted into movement of the belt 24.

An upper belt guide surface 28 on the inner body portion 12 extends between the idler sprocket 20 and drive sprocket 16 and provides a surface along which the belt 24 is guided in its movement from the idler sprocket 20 to the drive sprocket 16. A lower belt guide surface 30 on the inner body portion 12 extends between the drive sprocket 16 and the idler sprocket 20 and provides a surface along which the belt 24 is guided in its movement from the drive sprocket 16 to the idler sprocket 20.

The exterior surface 32 of the belt 24 is provided with a plurality of evenly spaced projections or pins 26. The pins 26 are designed to engage correspondingly spaced perforations along the outer edges of the paper (not shown) which is advanced by the tractor device 10.

Figure 3:
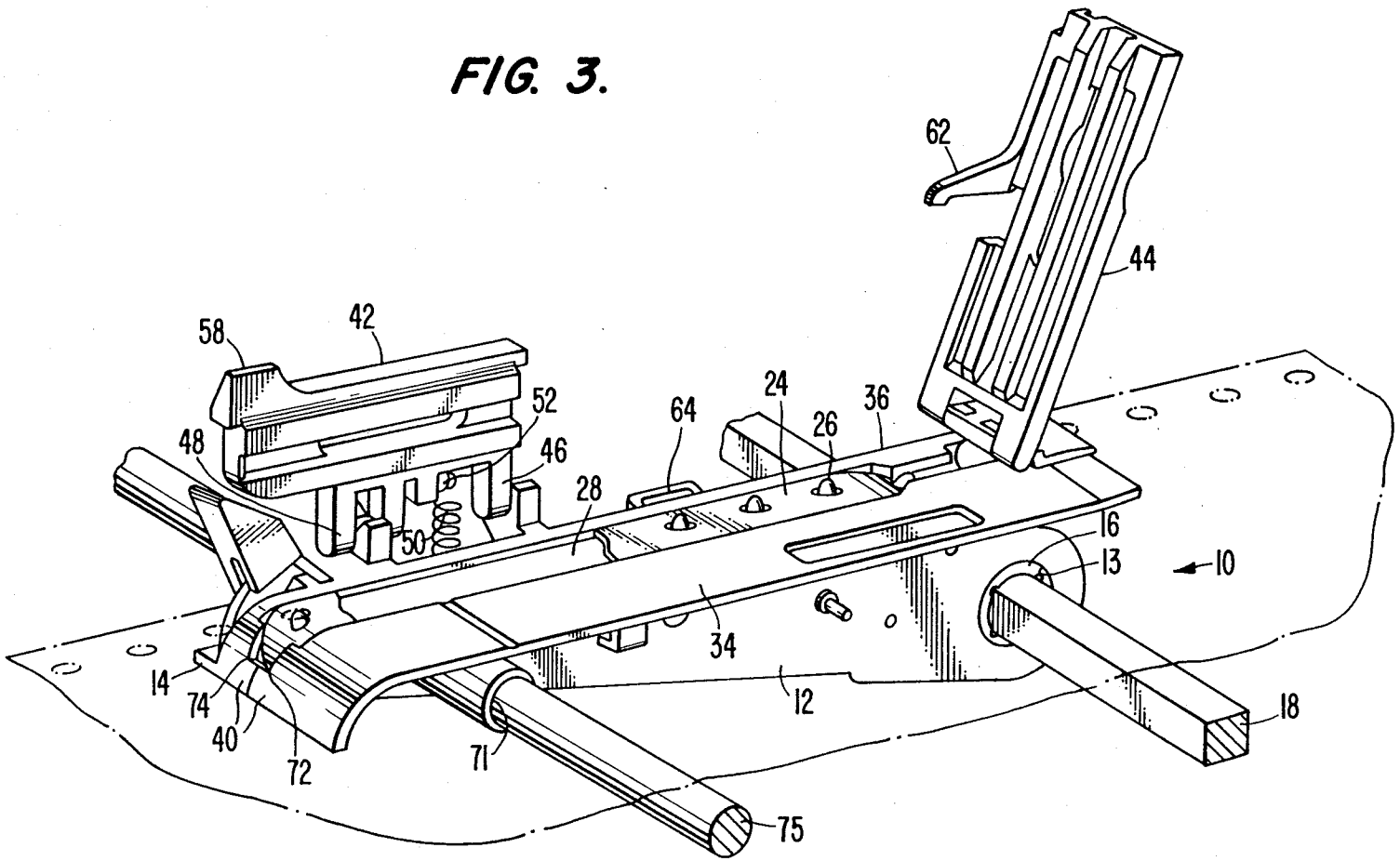
FIG. 3 is a top view of the assembled tractor with front and rear panels in the "open" position and with the tractor belt removed

FIG. 3 depicts the tractor 10 with the belt 24 removed. The top surface 34 of the inner tractor body portion 12 further includes a substantially flat extended flange or shelf. The top surface 36 of the outer tractor body 14 also comprises a substantially flat surface, although narrower in width than the shelf of the surface 34. When the inner tractor body 12 and outer tractor body 14 are joined together, the surfaces 34 and 36 form a substantially planer paper guide surface 40.

The upper belt guide surface 28 is positioned with respect to the paper guide surface 40 so that the exterior surface 32 of the belt 24 lies flush with the paper guide surface 40 throughout much of the length of the guide surface 40. The belt 24 and paper guide surface 40 thereby together present a substantially continuous planer surface across which paper may be guided.

Referring again to FIG. 2, the belt 24 does not travel between the idler sprocket 20 to the drive sprocket 16 in a linear path. The upper belt guide surface 28 bends downward, away from the plane defined by the paper guide surface 40, at a point approximately two thirds of the distance between the idler sprocket 20 and the drive sprocket 16. The belt 24 is thereby directed downward along the curved surface of the upper belt guide surface 28 toward the drive sprocket 16, which itself is positioned below the plane of the paper guide path 40 relative to the position of the idler sprocket 20. The belt 24 therefore travels in what may be referred to as a curved or "triangular" path between the idler sprocket 20 and drive sprocket 16, initially travelling in a path co-planar with the paper guide surface 40 after rounding the idler sprocket and then bending downward away from the plane of the paper guide surface and toward the drive sprocket 16. Although the belt path veers downward toward the drive sprocket, the direction of paper travel remains substantially horizontal throughout the tractor body.

The position of the keyed drive shaft 18 below the plane of paper travel defined by the paper guide surface 40 substantially reduces the possibility of interference between the paper and the drive shaft 16 (caused, for example, by paper sag between a pair of tractors). Because the possibility of interference between the keyed drive shaft 18 and paper is significantly reduced in the present invention, the need for a "dummy" tractor between a tractor pair to support the sagging paper is likewise eliminated.

The gradual curvature of the belt 24 away from the plane of paper travel defined by the paper guide path 40 allows the belt pins 26 to disengage or pull out from the paper perforations without tearing the paper. Instead of the five to fifteen millimeter "pull out" radius typically found in many tractors, the present invention allows the tractor belt to exit the paper path with a more gradual "pull out" radius of approximately fifty millimeters. This relatively large pull out radius enables the use of a belt pin profile that does not tear single part paper forms, and which drives all layers of multi-part paper forms with approximately equal force.

Figure 4:
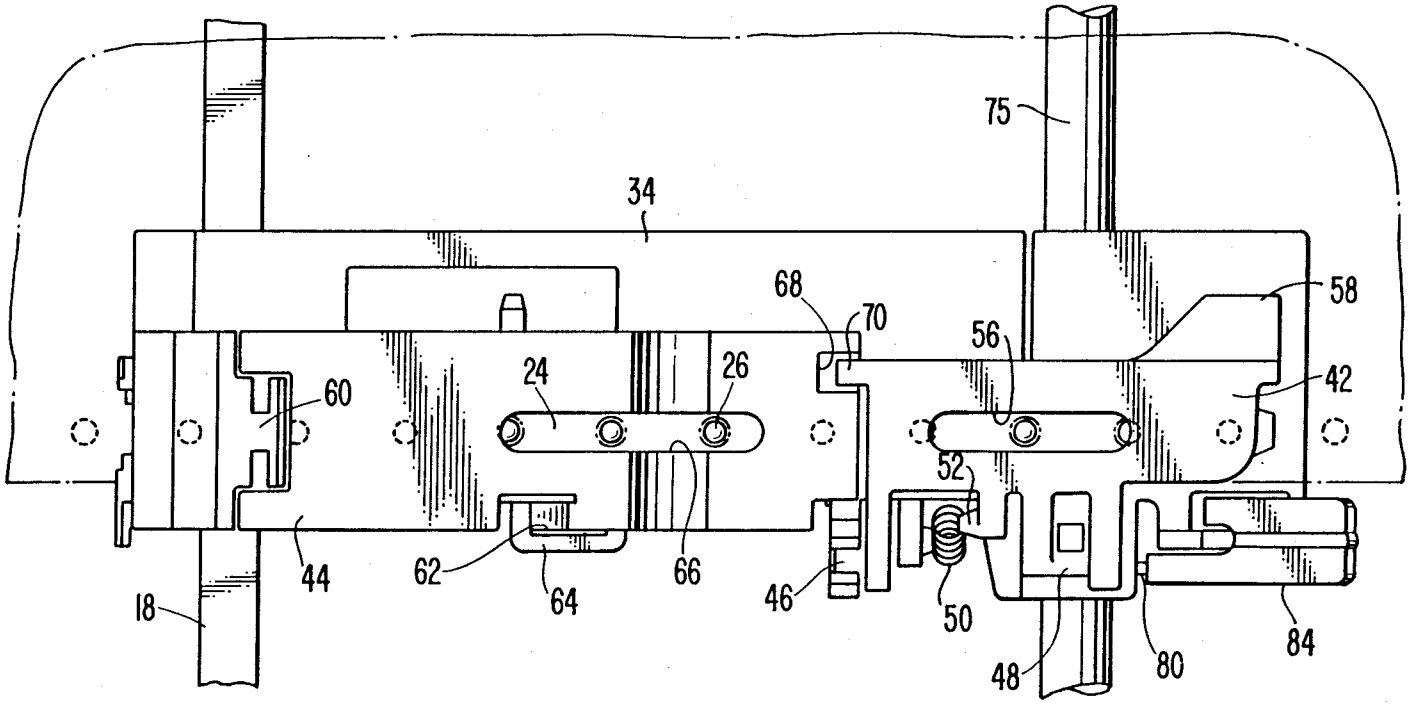
FIG. 4 is a top view of the assembled tractor with front and rear panels in the "closed" position
Figure 7:
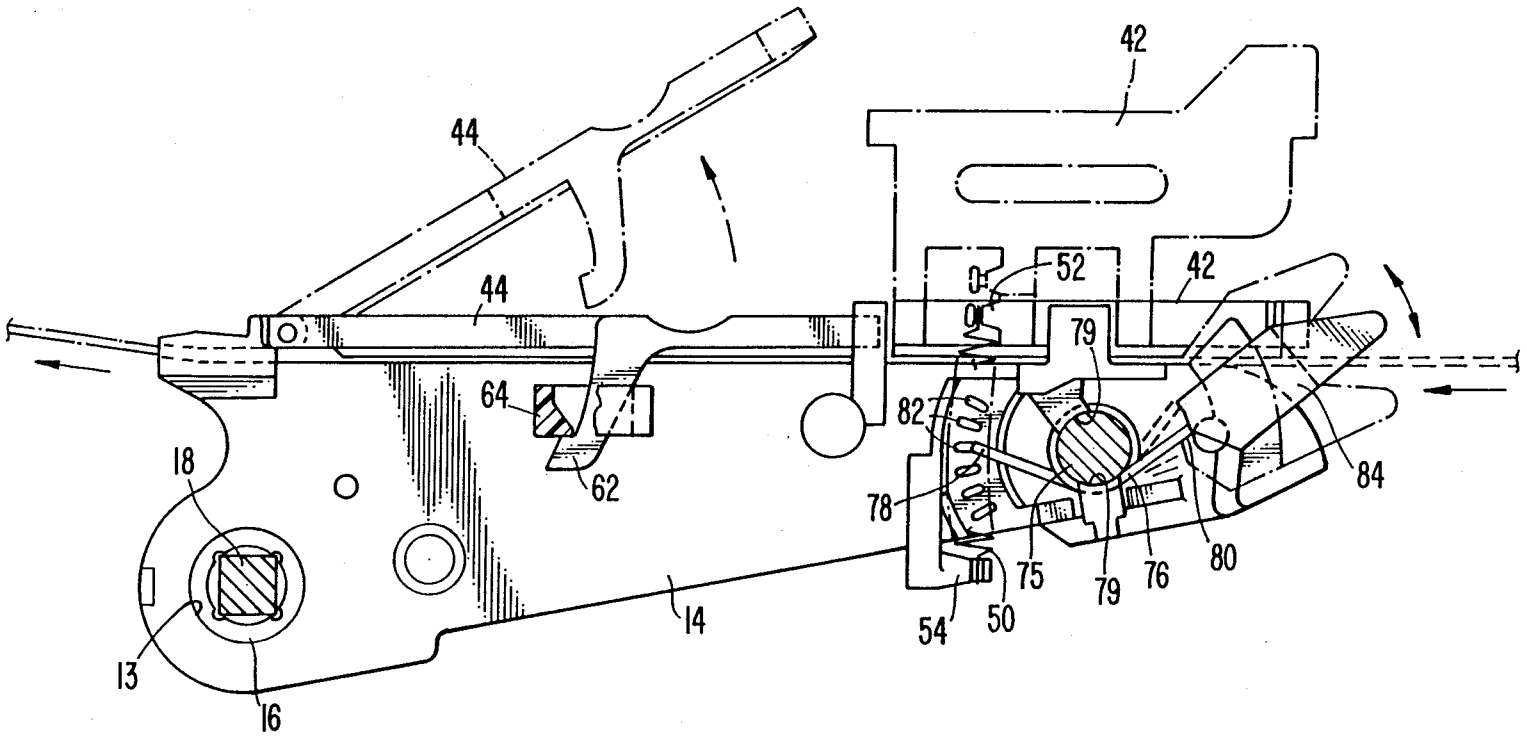
FIG. 7 is a side view of the exterior of the outer body panel of the tractor assembly with the torsion spring in position.

The paper is maintained in position against the paper guide surface 40 and belt 24 by means of a front panel 42 and a rear panel 44 as shown in FIG. 4. The front panel 42 is attached to the outer body portion 14 by means of hinges 46 and 48 which are aligned parallel to the paper guide path 40. A coil spring 50 is connected between an extension 52 on the front panel 42 and an extension 54 on the outer body 14 as shown in FIG. 7. The spring 50 is biased so that the front panel 42 may be maintained in either a first stable position or a second stable position.

In the first or "closed" stable position, which is depicted in FIG. 4, the front panel 42 lies in plane essentially parallel to that defined by the paper guide path 40. In this first position, the front panel 42 is biased by the spring 50 to maintain the paper in engagement with the pins 26 of the belt 24. The front panel 42 may include an oblong aperture 56 which allows approximately two or three of the belt pins 26 to be observed through the front panel 42 when the front panel is in the closed position A tab 58 extending from the front panel 42 is provided to enable the front panel 42 to be manually "flipped" between the open position and the closed position.

In the second or "opened" stable position, which is depicted in FIG. 3, the front panel 42 is pivoted about hinges 46 and 48 by approximately ninety degrees from the closed position to a position substantially perpendicular to the plane defined by the paper guide path 40. While in the open position, the front panel 42 exposes approximately three of the pins 26 on the belt 24 near the front end of the tractor 10. Using one door to expose only two to three pins (instead of the usual six to eight pins) makes it easier for operators to judge proper placement and alignment of paper on the left and right tractors, and to verify correctness of alignment before operation. After the paper is advanced, the operator has the advantage of the paper being engaged automatically on a greater number of pins than previous tractor designs, providing a more positive drive system that is easier to load.

The rear panel 44 is attached to the outer body portion 14 by means of a hinge 60 which has its pivot axis aligned in a direction substantially perpendicular to the paper guide path 40. The rear panel 44 may be rotated about hinge 60 to either of two different positions.

In the first or "closed" position, as depicted in FIG. 4, the rear panel 44 lies in a plane essentially parallel to that defined by the paper guide path 40. The rear panel 44 may be secured in the closed position by a rear panel finger 62 fixed to the rear panel 44 which engages a rear panel lock 64 fixed on the outer body portion 14. The rear panel 44 may include an oblong aperture 66 which allows approximately two or three of the belt pins 26 to be observed through the rear panel 44 when the rear panel is in the closed position.

In the second or "opened" position, as depicted in FIG. 3, the rear panel 44 is pivoted about hinge 60 by approximately one hundred fifteen degrees, to a position generally perpendicular to the plane defined by the paper guide path 40. When the rear panel 44 is moved to the open position, approximately five of the guide pins 26 on the belt 24 are exposed to the operator.

The rear panel 44 also includes a recessed groove 68 which is configured to receive an extension 70 on the front panel 42 when both the front panel 42 and rear panel 44 are in the closed position. The force exerted by spring 50 to maintain the front panel in the closed position is transmitted, via extension 70 resting in recessed groove 68, to thereby also maintain rear panel 44 in the closed position.

During a paper loading operation, only the front panel 42 must be swung to the open position. The rear panel may remain in the closed position.

In the front panel open position only three of the pins 26 found along the engagement surface of the belt 24 are exposed. Because the operator is not required to align the paper along the entire engagement surface of the belt, loading and alignment of paper is simplified by the use of front and rear panels 42 and 44. Closing the front panel 42 applies pressure on the rear panel 44 and on the paper itself through means of the front panel extension 70 and rear panel recess groove 68. When the belt 24 is advanced, the paper forms are automatically fed under the rear panel 44.

In the case of a paper misfeed or jam, both the front panel 42 and the rear panel 44 may be moved respectively from their closed positions to their open positions, thereby exposing all eight pins 26 on the engagement surface of the belt 24. This allows the cause of the jam or misfeed to be cleared easily and completely. The use of a front panel 42 and rear panel 44, rather than a single panel, thereby allows for ease of loading, ease of clearing jams, and the application of maximum driving force by allowing the simultaneous use of all eight pins of the engagement surface of the belt 24.

In the preferred embodiment of the present invention, the belt teeth 22 are spaced apart at a "pitch" of one-eighth inch (i.e., eight belt teeth per inch). The belt pins 26 are spaced apart by a "pitch" of one-half inch (i.e., two belt pins per inch). As a result, every belt pin 26 may be associated with four corresponding belt teeth 22.

The drive sprocket 16 has twenty equally spaced teeth 23 disposed about its periphery and is driven by a keyed drive shaft 18 having four sides of equal width. Therefore there are five sprocket teeth per shaft side.

Because of this geometry, there are only four possible positions of belt to belt alignment when two tractors 10 of the present invention are mounted on a single drive shaft 18. That is, the belt pins 26 of the tractor pair must either be in perfect alignment with one another or misaligned by one belt tooth, two belt teeth or three belt teeth. If the alignment between the pins of the tractor pair is not correct, one of the tractors 10 can be removed from the drive shaft 18 and the drive sprocket 16 rotated by ninety degrees, one hundred eighty degrees, or two hundred seventy degrees, until the alignment is correct. Thus, alignment of belt pins 26 during printer assembly is a simple matter of rotating the drive sprocket 16 of one tractor 10 by one quarter, one half or three quarter turn.

A similar geometric alignment system may be used for drive shafts having a number of sides greater or less than four. In general, tractor alignment may be achieved by the geometric arrangement of the present invention whenever the number of belt teeth per pin is equal to N, the number of sides of the drive shaft is equal to M, and the number of sprocket teeth is equal to $M(N+1)$, where N and M are non-zero integers. Alignment may then be achieved after N-1 maximum number of advancements of $1/M(360)$ degree increments. For example, if $N=4$ and $M=4$, then $N-1=3$ advancements of $1/4(360)=90$ degrees will align the tractors. This alignment technique eliminates the need for a special key on the drive sprocket or a double tooth on the belt, both of which have been previously used to ensure proper alignment of tractor belt pairs.

As the belt pins 26 travel around the idler sprocket 20, a means is provided for preventing the pins 26 from being exposed at a height which would allow the pins 26 to catch an operator's fingers or clothing. This means is provided in the form of a first protective element 72 on the inner body portion 12 and a second protective element 74 (which is a mirror image of element 72) on the outer body portion 14 near the front panel 42, as shown in FIG. 3. The elements 72 and 74 on body portions 12 and 14 come together to cover the pins 26, yet provide an aperture 93 through which the pins 26 may be viewed. With the front panel 42 in the closed position, the area exposed by aperture 93 is further reduced, and the pins 26 present no threat of injury to the operator. Elements 72 and 74 allow the operator to feed and load paper with the printer's casework door open Underwriters' Laboratory (UL) requires an interlock switch to shut off power to the printer if the possibility exists that the operator may be injured when the printer's casework door is opened. Elements 72 and 74 make the tractors safe for operator use and thereby eliminate the need for an interlock switch. Therefore, the operator can open the casework door and view the feeding operation, since no interlock switch is needed.

Documents come in varying widths, and the spacing of the perforations with respect to the edge of a document may vary as well. Accordingly, each tractor 10 must be positionable (i.e., movable axially) along the keyed drive shaft 18 and support shaft 75. When proper alignment between the tractor 10 and the document perforations is obtained, a means must be provided for fixing the position of the tractor 10 with respect to the document A means must also be provided to allow repositioning of the tractor 10 for a differently sized document This is accomplished in the present invention by use of a metal torsion spring 76 which surrounds the support shaft 75.

Figure 6:
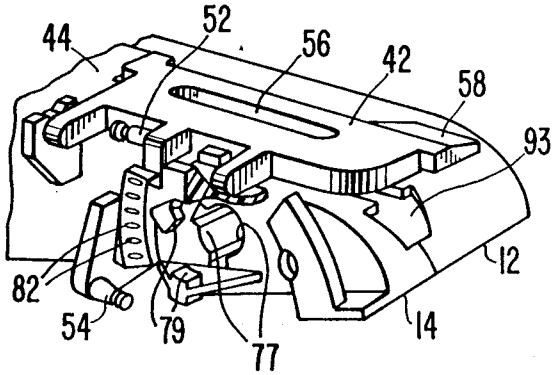
FIG. 6 is a section side view in elevation of the front exterior portion of the outer body of the tractor and is included to show the journal bearings of the outer panel with tortion spring removed.
Figure 5:
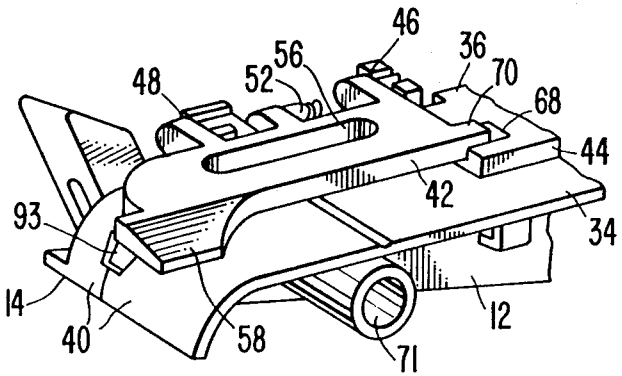
FIG. 5 is a side view in elevation of the front exterior portion of the inner body of the tractor and illustrates the journal bearing of the inner body.

Both the inner body portion 12 and the outer body portion 14 have journal bearing surfaces which support the support shaft 75. On the inner body portion 12, as shown in FIG. 5, the bearing surface is in the form of a continuous cylindrical surface 71 which completely surrounds the support shaft 75. On the outer body portion 14, as shown in FIG. 6, the support shaft bearing surface is divided into a first level 77 and a second level 79, with the two levels being separated by a space of approximately six to ten millimeters. Each bearing level comprises a cylindrical surface bifurcated at two locations, creating two bearing "points" at each level on which the shaft 75 is supported. The first level 77 and second level 79 thereby together form a two-level, four-point bearing surface for support of the shaft 75.

As shown in FIG. 7, before the tractor 10 is installed on the support shaft 75, a metal torsion spring 76 is positioned in the space between the first bearing level 77 and second bearing level 79. A first end 78 of the spring 76 is fixed in one of several apertures 82 formed on the outer body portion 14. (Due to the variety of tolerances of the tortion spring 76 and shaft 75, there are multiple adjustment apertures 82 into which the first end 78 of the spring 76 may be inserted.) The second end 80 of the spring 76 is permanently attached to a plastic handle 84.

To install the tractor 10 on the support shaft 75, the plastic handle 84 is first depressed in a clockwise direction, as shown in FIG. 7. This causes the torsion spring 76 to unwind to a small degree, thereby causing the inner diameter of the spring 76 to expand slightly such that the support shaft 75 may easily pass therethrough. Once the tractor 10 is properly positioned relative to the support shaft 75, the handle 84 is released, causing the spring 76 to tighten around and grip the support shaft 75. Since the spring 76 which grips the shaft 75 is also fixed in position between the first bearing level 77 and second bearing level 79, the tractor 10 is locked in position and is unable to move axially along the shaft 75.

The use of metal torsion spring 76 in this manner provides a very stable tractor because each body portion 12 and 14 has a bearing on the shaft 75. The tractor 10 does not "float" on the shaft 75, thus improving print registration, anti-crabbing during movement of tractors and reduced skewing during loading of forms or documents. When locked, the force needed to move the tractor 10 is very high. Yet depressing the handle 84 allows easy movement for tractor adjustment. The operator cannot forget to lock the tractor 10 because the use of the torsion spring 76 makes the tractor "self-locking".

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A device for relatively positioning a tractor and a support shaft comprising:

a bearing member attached to said tractor and having an internal bearing surface including a torsion spring having several windings circumferentially wound about said shaft, the dimensions of said bearing surface being adjustable from a first diameter enabling relative diameter preventing relative movement between said shaft and said tractor.

2. A device for positioning a web feeding tractor body axially along a support shaft, comprising:

a torsion spring wound about said support shaft a plurality of times so as to provide a frictional gripping force for gripping said support shaft, said torsion spring having a first end secured to said web feeding tractor body and a second end operable to be moved in an unwinding direction for unwinding said torsion spring from around said support shaft to thereby reduce said frictional gripping force;

whereby said web feeding tractor body is manually positionable in the axial direction of said support shaft upon reducing of said frictional gripping force.

3. A device as claimed in claim 2, wherein said web feeding tractor body has a plurality of spaced apart apertures, each aperture is adapted to receive said first end of said torsion spring for securing said first end of said torsion spring to said web feeding tractor body;

whereby the degree of said frictional gripping force is dependent upon the aperture in which said first end of said torsion spring is received.

4. A web feeding tractor which is positionable in the axial direction of a support shaft, comprising:

a first support shaft bearing surface having first and second levels separated by a space, first and second levels each have a cylindrical surface which is bifurcated at two locations;

a torsion spring disposed within said space separating said first and second levels, said torsion spring being wound about and frictionally secured with said support shaft;

movable releasing means, operable to be moved in a first direction for unwinding said torsion spring from about said support shaft to thereby release said torsion spring from being frictionally secured with said support shaft;

wherein said torsion spring is positioned to automatically urge said releasing means in a second direction for winding said torsion spring about said support shaft so as to automatically frictionally secure said torsion spring with said support shaft;

whereby said first support shaft bearing surface is manually positionable in the axial direction of said support shaft upon the operation of said moveable releasing means in said first direction.

5. A device for positioning a web feeding tractor body axially along a support shaft, comprising:

a torsion spring wound about said support shaft so as to provide a frictional gripping force for gripping said support shaft, said torsion spring having a first end secured to said web feeding tractor body, a second end operable to be moved in an unwinding direction for unwinding said torsion spring from around said support shaft to thereby reduce said frictional gripping force, and an intermediate portion between said first and second ends, said intermediate portion being free with respect to the tractor body;

whereby said web feeding tractor body is manually positionable in the axial direction of said support shaft upon reducing of said frictional gripping force.

6. A device as claimed in claim 5, wherein said web feeding tractor body has a plurality of spaced apart apertures, each aperture is adapted to receive said first end of said torsion spring for securing said first end of said torsion spring to said web feeding tractor body;

whereby the degree of said frictional gripping force is dependent upon the aperture in which said first end of said torsion spring is received.

* * * * *